US007928913B2

(12) United States Patent
Kaneda et al.

(10) Patent No.: US 7,928,913 B2
(45) Date of Patent: Apr. 19, 2011

(54) METHOD AND APPARATUS FOR A TUNABLE CHANNELIZING PATCH ANTENNA

(75) Inventors: Noriaki Kaneda, Westfield, NJ (US); Carsten Metz, München (DE)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 163 days.

(21) Appl. No.: 12/194,565

(22) Filed: Aug. 20, 2008

(65) Prior Publication Data

US 2010/0045550 A1 Feb. 25, 2010

(51) Int. Cl.
*H01Q 1/38* (2006.01)

(52) U.S. Cl. ..... 343/700 MS; 343/846

(58) Field of Classification Search ..... 343/700 MS, 343/702, 848, 846
See application file for complete search history.

(56) References Cited

U.S. PATENT DOCUMENTS

| | | | | | |
|---|---|---|---|---|---|
| 4,475,108 | A * | 10/1984 | Moser | ..... | 343/700 MS |
| 4,529,987 | A * | 7/1985 | Bhartia et al. | ..... | 343/700 MS |
| 4,777,490 | A * | 10/1988 | Sharma et al. | ..... | 343/754 |
| 4,780,724 | A * | 10/1988 | Sharma et al. | ..... | 343/700 MS |
| 4,827,266 | A * | 5/1989 | Sato et al. | ..... | 343/700 MS |
| 6,005,519 | A * | 12/1999 | Burns | ..... | 343/700 MS |
| 6,501,427 | B1 * | 12/2002 | Lilly et al. | ..... | 343/700 MS |
| 6,677,901 | B1 * | 1/2004 | Nalbandian | ..... | 343/700 MS |

* cited by examiner

*Primary Examiner* — HoangAnh T Le
(74) *Attorney, Agent, or Firm* — Wall & Tong LLP

(57) ABSTRACT

A method and apparatus providing a tunable channelized patch antenna by selectively adjoining one or more radiating element extensions successively to a radiating element of the patch antenna, and adjusting fringe capacitance at active outer edges of the patch antenna.

22 Claims, 7 Drawing Sheets

METHOD AND APPARATUS FOR A TUNABLE CHANNELIZING PATCH ANTENNA

FIELD OF THE INVENTION

Various embodiments generally relate to wide band antennas and, more particularly, to tunable patch antennas.

BACKGROUND OF THE INVENTION

Patch antennas are known in the art. They typically comprise a metal sheet (patch) of specific dimensions with one or more carefully positioned feeds that is suspended over a ground plane. Patch antennas are generally small in size and utilized in higher frequencies (e.g., UHF and above), low profile applications. Such applications may include airborne and terrestrial vehicular applications, where form factor and aerodynamic drag of the antenna is a concern. Common applications of patch antennas in this regard are satellite radio antennas on an automobile or GPS antenna on an aircraft.

Although patch antennas offer the above-mentioned benefits, the bandwidth of existing patch antennas is generally limited by the chosen dimensions of the patch. This makes many existing patch antenna designs inherently narrow band in their operation, and have limited usefulness in certain applications.

SUMMARY

Various deficiencies of the prior art are addressed by apparatus and methods providing a tunable patch antenna.

In one embodiment, a patch antenna includes a radiating element, one or more radiating element extension pairs, a ground plane disposed beneath the radiating element and the one or more radiating element extension pairs, and coupling means for selectively adjoining the one or more radiating element extension pairs successively to the radiating element.

In another embodiment, a patch antenna includes a radiating element, a ground plane, and tunable capacitive elements disposed between the radiating element and ground plane.

In another embodiment, a patch antenna includes a radiating element, one or more radiating element extensions, and coupling means for selectively adjoining the one or more radiating element extensions successively to the radiating element.

In yet another embodiment, a method for tuning a patch antenna includes selectively adjoining one or more radiating element extensions successively to a radiating element of the patch antenna, and adjusting fringe capacitance at active outer edges of the patch antenna.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF THE INVENTION

Various embodiments will be primarily described within the context of a tunable patch antenna, however, those skilled in the art and informed by the teachings herein will realize that various embodiments are also applicable to other antenna geometries and RF tuning applications.

Figure 1A:
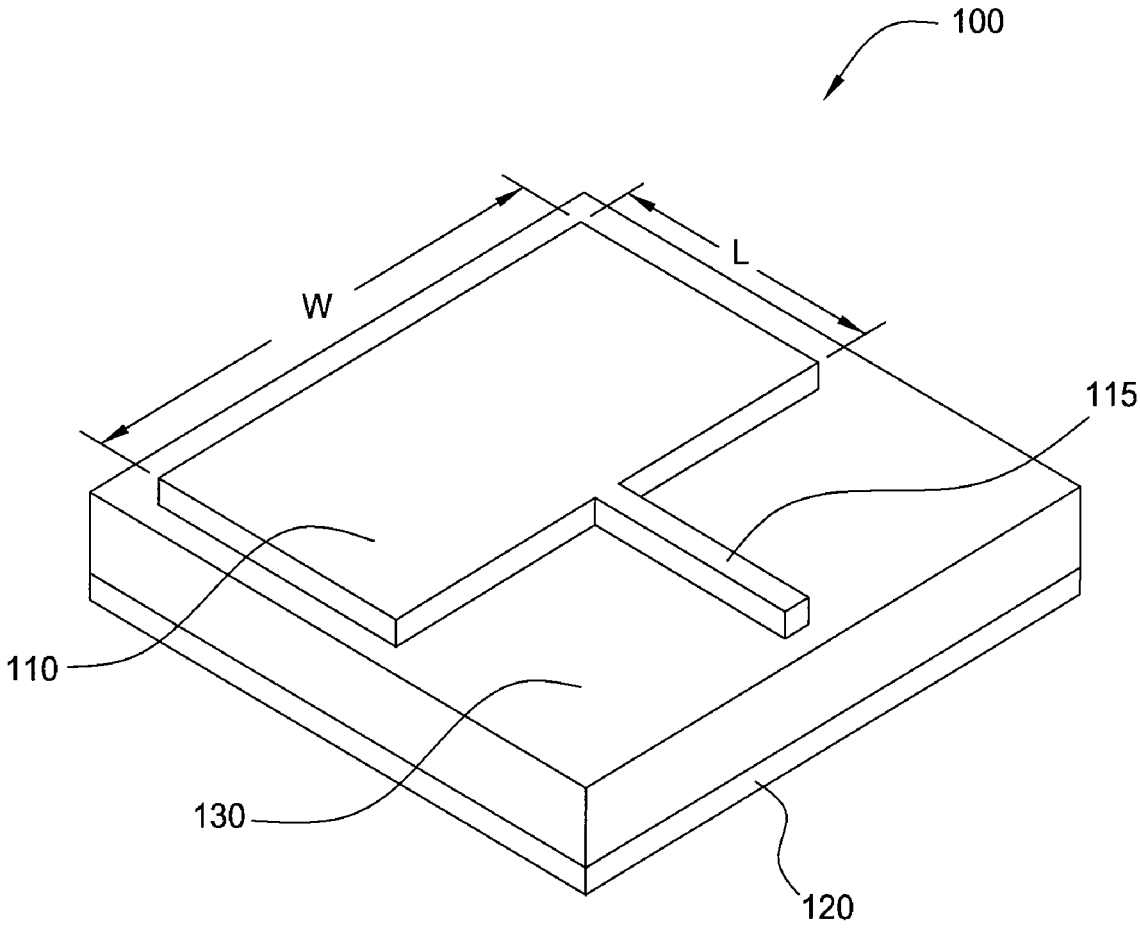
FIG. 1A (PRIOR ART)
FIG. 1A depicts a perspective view of a patch antenna as known in the art.
Figure 1B:
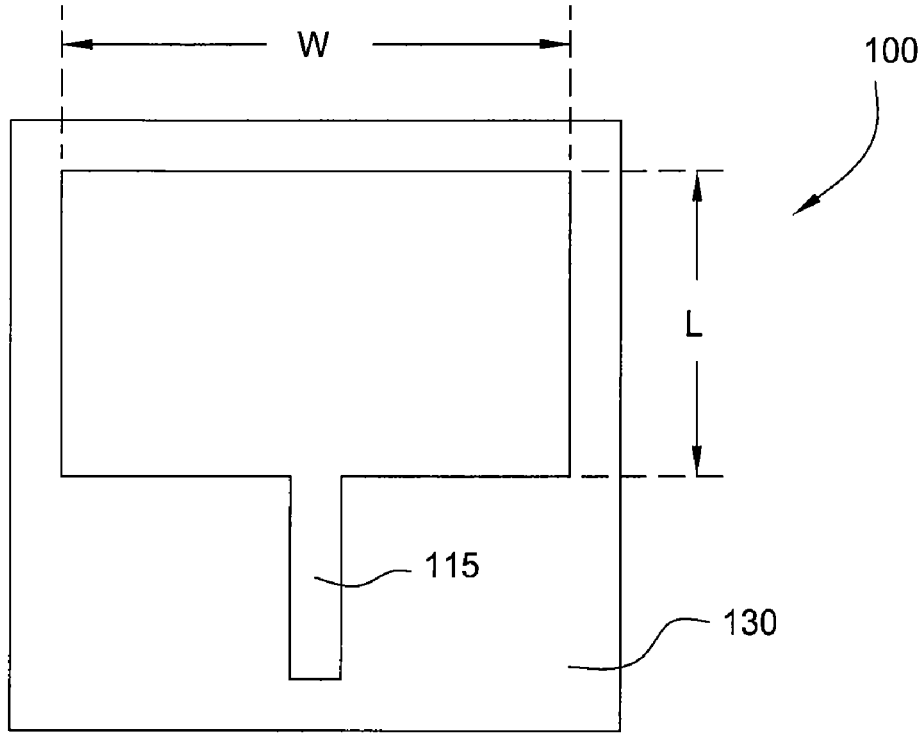
FIG. 1B (PRIOR ART)
FIG. 1B depicts a top view of a patch antenna as known in the art.
Figure 1C:
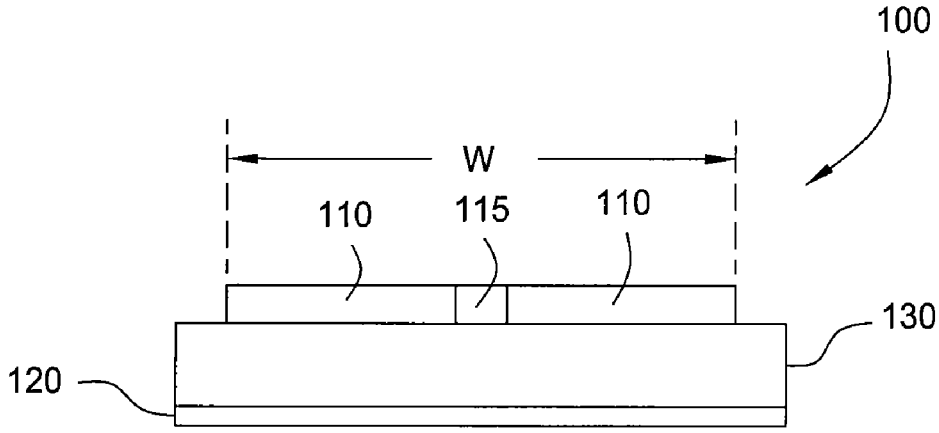
FIG. 1C (PRIOR ART)
FIG. 1C depicts a side view of a patch antenna as known in the art.

FIG. 1A depicts perspective view of an exemplary patch antenna 100 as presently known in the art. Patch antenna 100 is printed on one side of a microstrip substrate. It includes a radiating element 110 having a length 'L' and width 'W,' interacting with feed 115, disposed over a ground plane 120 and separated by a dielectric substrate 130. FIGS. 1B and 1C respectively display top and side views (on the feed side) of patch antenna 100 and its components (110, 115, 120 and 130). Various embodiments to be described will be discussed with respect to their top and side views, which may be compared to FIGS. 1B and 1C.

Patch antenna 100 is a rectangular design. However, it is known in the art that patch antennas can be constructed with other geometries, including other basic shapes (squares, triangles, etc), customized shapes particular to a specific application and fractals. Feed 115 is depicted as a microstrip feed line, but it is known in the art that other feed line types/arrangements are possible, such as coaxial cables. It will also be appreciated by those skilled in the art that a configuration such as patch antenna 100, with a single feed positioned at an offset from the center of radiating element 110 will produce and support linear polarization. Radiating edges of the patch antenna in this case and in the following description are located at the right and left edges of the radiating element 110 parallel to the feed line. For this operation of the patch antenna (radiating edges parallel to the feed line), the feed line needs to be located with an offset from the center of the patch element to achieve good impedance matching to 50 ohm input.

Patch antenna designs, such as patch antenna 100 are inherently "narrow band" in their operation due to the electrically short substrate height and often the material of the substrate. A narrow-band antenna such as a patch antenna is often avoided in many applications that require wide bandwidth to cover multiple operating channels. However, the narrow-band characteristics of the patch antenna have been found by the inventor to be advantageous when combined with tunability. In a typical operation of an RF front-end, a reasonably wide bandwidth antenna is needed to receive an entire operating band. Preselected filters are then used to select either a receive band or a band within multiple bands or channels of interest. Since the conventional antenna lacks of ability to select bands or channels dynamically, there was no use to the narrow-band antenna. With tunable narrow band antenna, we can do 2 functions of RF front-end, namely receive radio wave and filter the unwanted signal and noise. Although filtering of a narrow band antenna is not as good as stand-alone filter, it can eliminate or alleviate the pre-select filter that follow antenna in conventional RF front design.

Various embodiments to be described address tunable antenna function.

In one embodiment, the resonant length of a patch antenna is increased by selectively extending its radiating element, by selectively adjoining (electrically) one or more successive radiating element extensions, thereby reducing the antenna's operational (resonant) frequency. Resonant frequency is then further adjusted, and impedance matching performed, by tuning fringe capacitance at the active edges of the patch antenna, between its ground plane, and the radiating element and one or more radiating extensions. In this manner, multi-octave wide-band antenna operation is obtained in various embodiments.

Figure 2A:
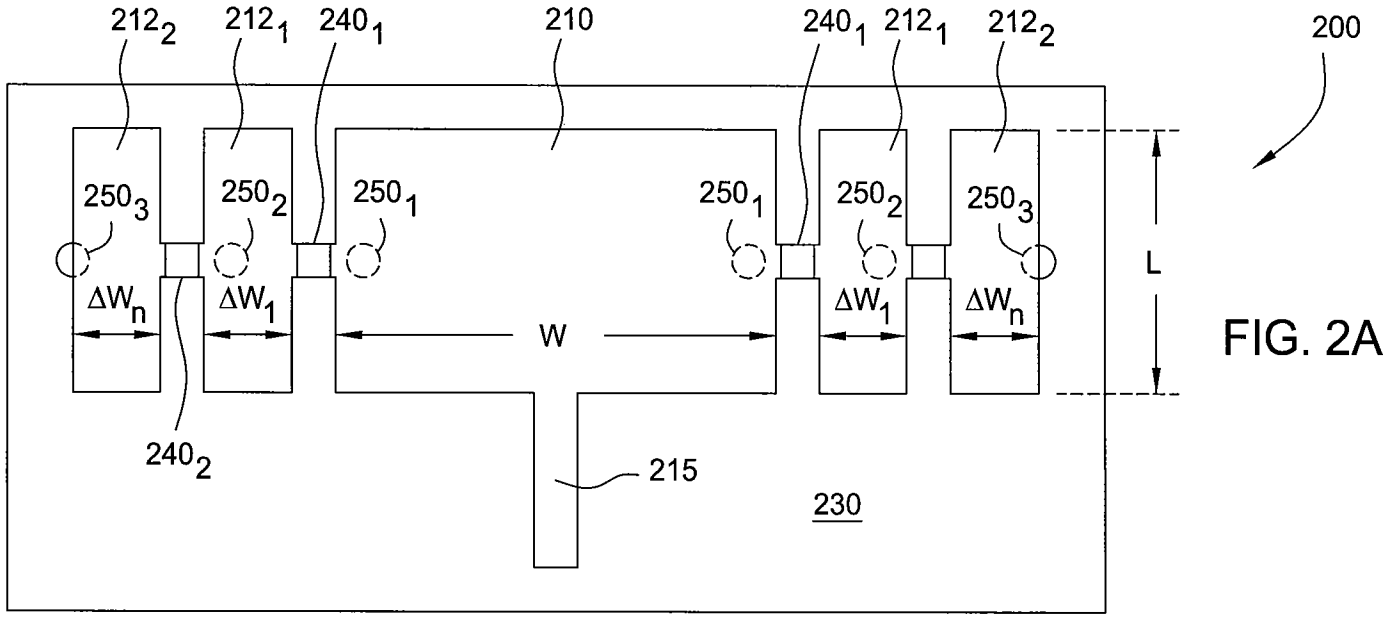
FIG. 2A depicts a top view of a patch antenna according to one embodiment.

FIG. 2A depicts a top view of a patch antenna 200, according to one embodiment. Patch antenna 200 includes a radiating element 210 and feed 215. Patch antenna 200 then includes on each side of the radiating element 210, extension patch pairs $\mathbf{212}_1$ and $\mathbf{212}_2$ of lengths $\Delta W_1$ and $\Delta W_2$. Radiating element 210 and extension patch pairs $\mathbf{212}_1$ and $\mathbf{212}_2$ are disposed atop a dielectric substrate 230, separating the elements from a ground plane 220 visible in FIG. 2B (not visible in top view of FIG. 2A) to be discussed shortly. Extension pairs $\mathbf{212}_1$ and $\mathbf{212}_2$ are connected to radiating element 210 and each other respectively by RF switch pairs $\mathbf{240}_1$ and $\mathbf{240}_2$. RF switch pairs $\mathbf{240}_1$ and $\mathbf{240}_2$ serve as a coupling means to electively extend the resonant length of patch antenna 200, by (when closed) adjoining extension pairs $\mathbf{212}_1$ and/or $\mathbf{212}_2$ to radiating element 210.

Each switch in RF switch pairs $\mathbf{240}_1$ and $\mathbf{240}_2$ is capable of operating over the spectral range of the antenna. Examples of such switches that may be utilized for this purpose in various embodiments include Micro Electro-Mechanical System (MEMS) switches and PIN diodes. However, those skilled in the art and informed by the teachings herein will realize that any suitable type of switch may be utilized without departing from the basic scope. Such switch-types are typically actuated by a DC bias supplied control circuitry (not shown). Control circuitry architectures for such switches are known in the art and can be configured in any suitable arrangement without departing from the basic scope. Although the particular embodiment represented by patch antenna 200 depicts one RF switch 240 between radiating element 210 and extension patch pairs $\mathbf{212}_1$ and $\mathbf{212}_2$, other embodiments are also contemplated where multiple switches may be utilized between elements.

In one embodiment, patch antenna 200 has a base mode of operation wherein both RF switch pairs $\mathbf{240}_1$ and $\mathbf{240}_2$ are open. The effective physical dimensions of the radiating portion (i.e., radiating element 210) of patch antenna 200 are thereby similar to a patch antenna of length 'L' and width 'W', as described with respect to patch antenna 100 of FIGS. 1A-C. In another mode of operation, switches 240 of RF switch pair $\mathbf{240}_1$ are closed, and radiating element extension pairs $\mathbf{212}_1$ (of length $\Delta W_1$) electrically adjoined with element 210. The length of $\mathbf{212}_1$ and $\mathbf{212}_2$ can be different or the same. When different lengths are used, the input impedance matching characteristics may be changed to provide for a wider or narrower operating antenna bandwidth and total tunable bandwidth. The effective physical width of the radiating portion of patch antenna 200 thus effectively becomes approximately $W+2*\Delta W_1$. In yet another mode of operation, both RF switch pairs $\mathbf{240}_1$ and $\mathbf{240}_2$ are closed, electrically adjoining both radiating element extension pairs $\mathbf{212}_1$ and $\mathbf{212}_2$ with radiating element 210. Patch antenna 200's effective physical width then becomes approximately $W+2*\Delta W_1+2*\Delta W_2$.

Figure 2B:
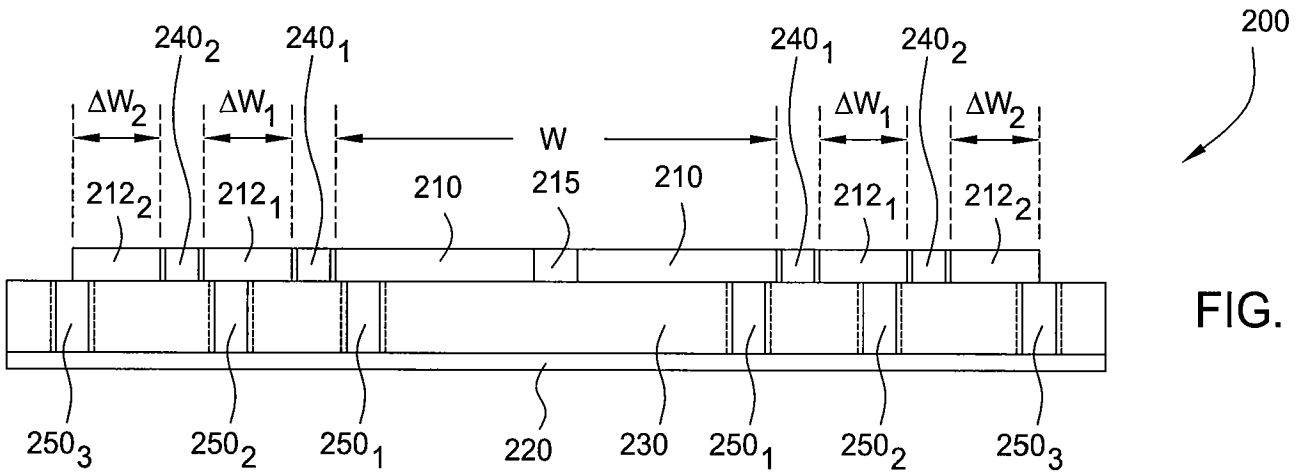
FIG. 2B depicts a side view of a patch antenna according to one embodiment.

FIG. 2B depicts a side view of patch antenna 200 according to one embodiment. In one embodiment, patch antenna 200 further comprises capacitive element pairs $\mathbf{250}_1$, $\mathbf{250}_2$ and $\mathbf{250}_3$ disposed between radiating element 210 and extension patch pairs $\mathbf{212}_1$ and $\mathbf{212}_2$, and ground plane 220, passing through substrate 230. In various embodiments, substrate 230 is typically drilled to accommodate capacitive elements 250, as indicated by the dotted lines bracketing the elements 250 in FIG. 2B. Capacitive elements 250 provide RF tuning to change the center frequency of the antenna and impedance matching for patch antenna 200. Capacitive elements 250 on left and right side of the main radiating element can have different values (for example two $\mathbf{250}_1$ can be different values), and provide additional freedom in RF tuning for input impedance matching. In one embodiment, capacitive elements 250 are varactor diodes, which provide a tunable lumped capacitance value controlled by a variable DC bias. The variable DC bias is supplied by control circuitry (not shown) of any suitable configuration, which can be determined by those skilled in the art without departing from the basic scope.

Although the particular embodiment represented by patch antenna 200 shows only one capacitive element 250 at the opposing edges of each respective radiating element 210 and extension patch pairs $\mathbf{212}_1$ and $\mathbf{212}_2$, other embodiments are also contemplated where multiple capacitive elements 250 are utilized. That is, various embodiments include performing antenna tuning and impedance matching by selectively controlling the edge capacitance, utilizing any suitable means, number of capacitive elements, or configuration(s) thereof.

Figure 3:
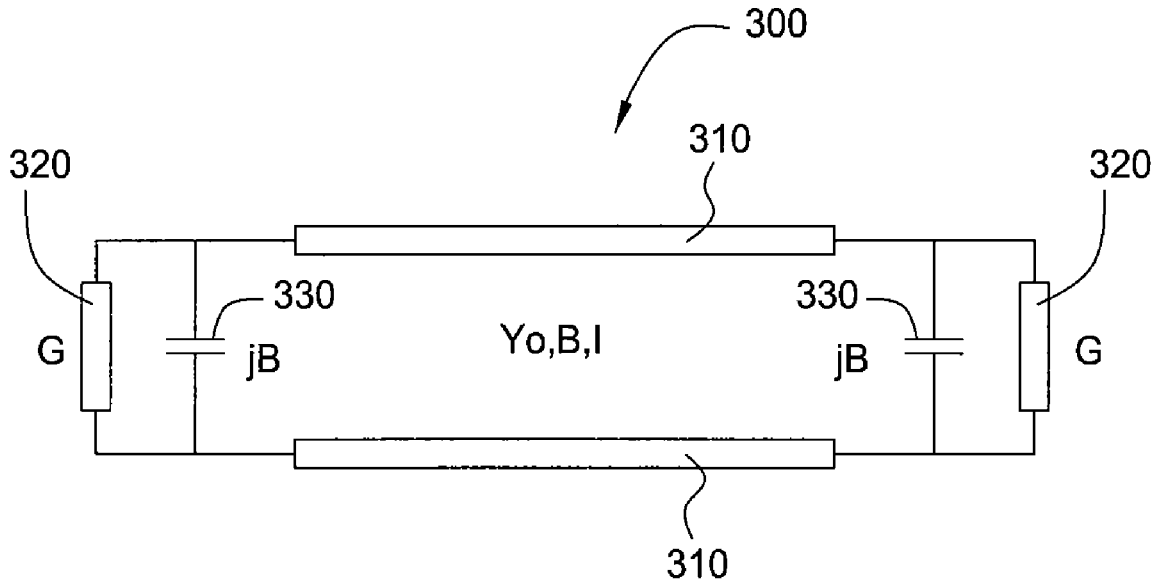
FIG. 3 depicts a transmission line model of patch a antenna according to the embodiments represented by FIGS. 2A and 2B.

The function of capacitive elements 250 within patch antenna 200 can be more readily understood by considering FIG. 3, depicting a transmission line model 300 of patch antenna 200 according to one embodiment. Transmission line model 300 includes a transmission line section 310 of length l, (corresponding to W in FIG. 2A) characteristic admittance $Y_0$ and propagation constant $\beta$. At each end of transmission line section 310 is a conductance 'G' 320 representing the radiation conductance at the edge of patch antenna 200, and a susceptance 'B,' including both the fringing capacitance of radiating element(s) and lumped capacitance of capacitive element 330. As the lumped capacitance of capacitive element 330 increases, the (shunt) susceptance 'B' increases, causing the resonant frequency of patch antenna 200 to decrease. Likewise, as extension patch pairs $\mathbf{212}_1$ and $\mathbf{212}_2$ are adjoined to radiating element 210, length l of transmission line section 310 increases reducing the resonant frequency of patch antenna 200, as shown in equation (1). In various embodiments, shunt susceptance 'B' is increased (e.g., additional capacitance is tuned into capacitive element 250), to maintain impedance matching to compensate for length l being increased. However, it is also contemplated that other tuning methodologies may be utilized without departing from the basic scope.

The relationship between length l, propagation constant $\beta$, admittance $Y_0$ and susceptance 'B' is expressed by equation (1).

$$\tan(\beta l) = \frac{2Y_0 B}{G^2 + B^2 - Y_0^2} \tag{1}$$

Figure 4A:
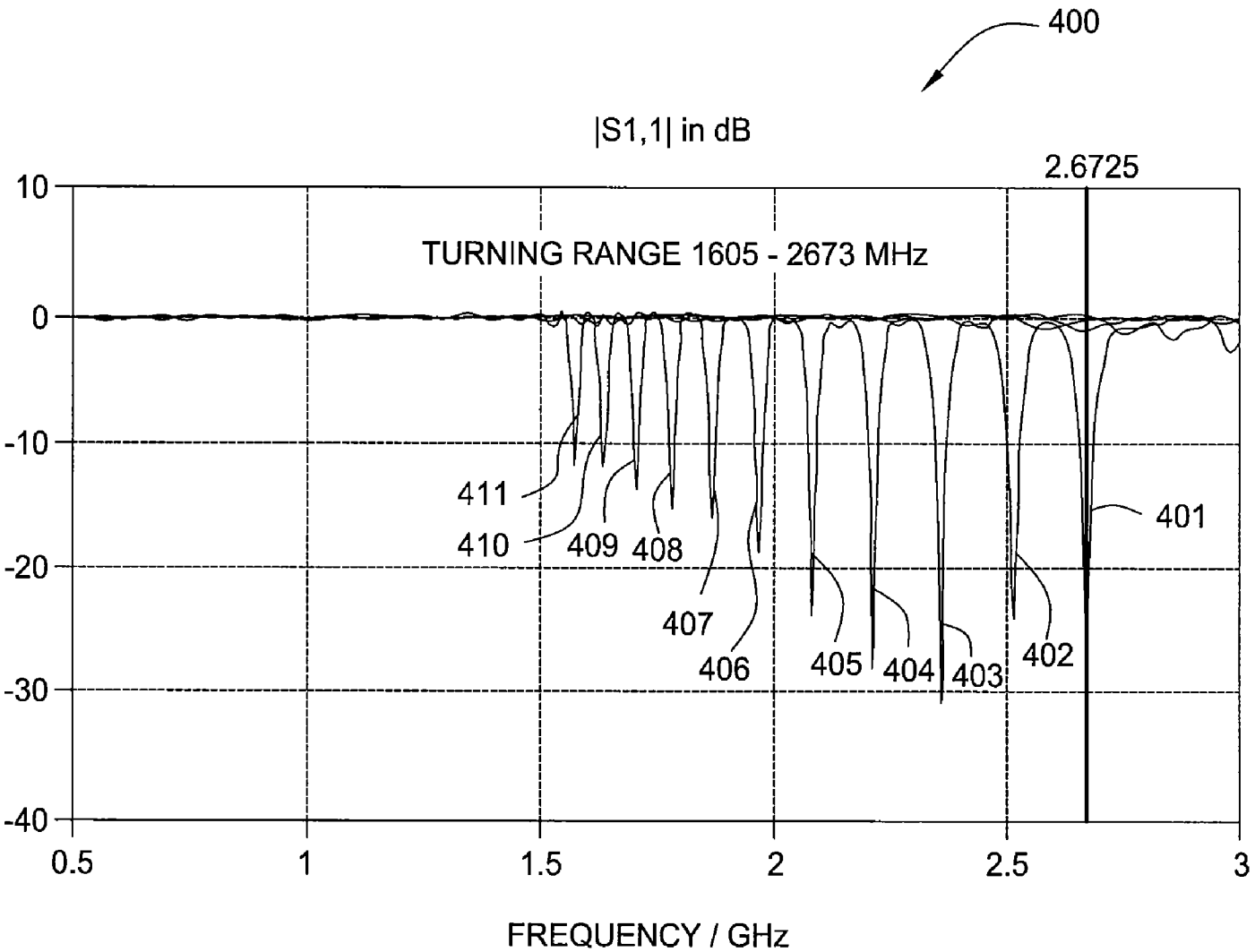
FIGS. 4A-4C depict |S1,1| logMag plots at various tuned frequencies of a patch antenna according to the embodiments represented by FIGS. 2A and 2B.
Figure 4B:
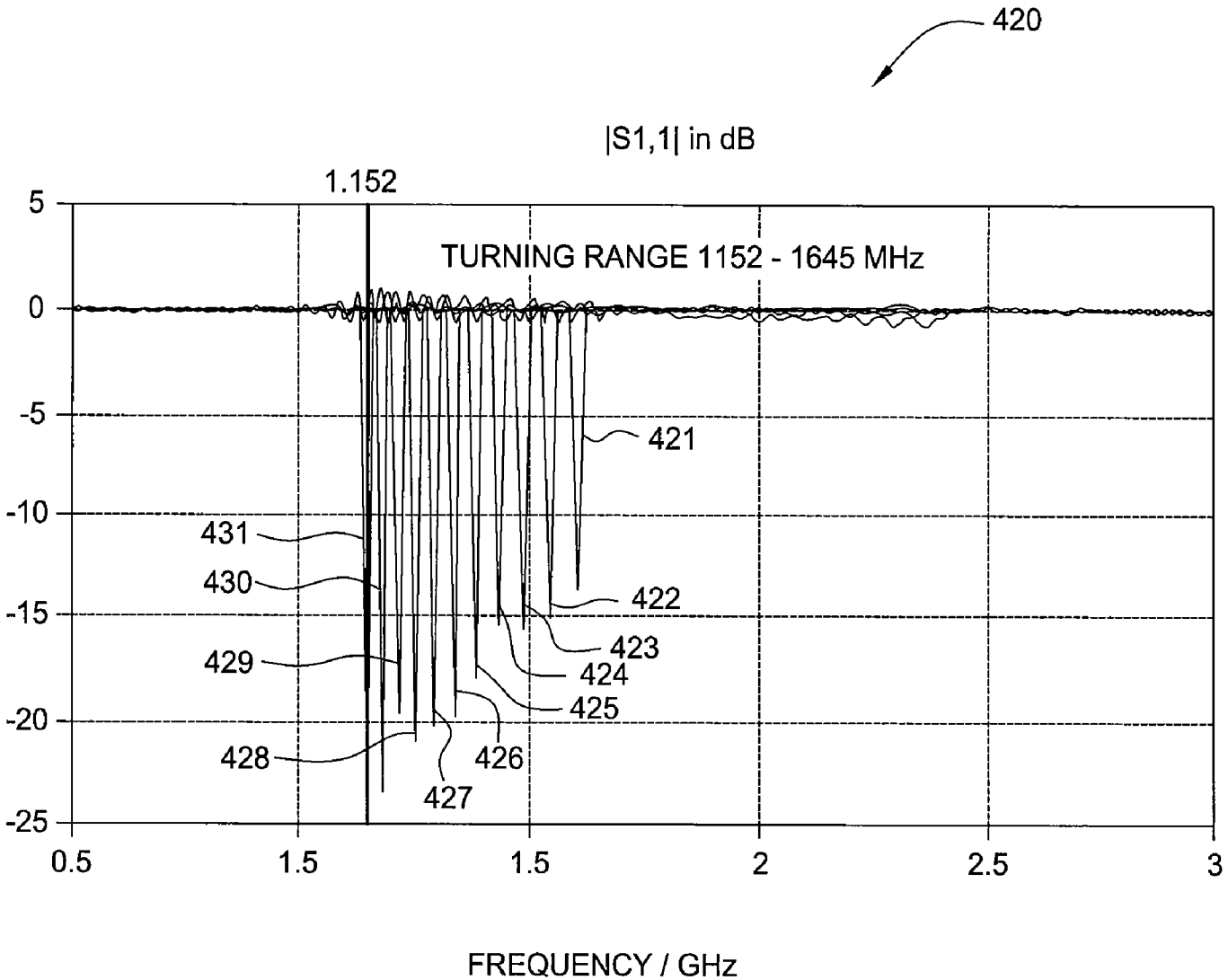
Figure 4C:
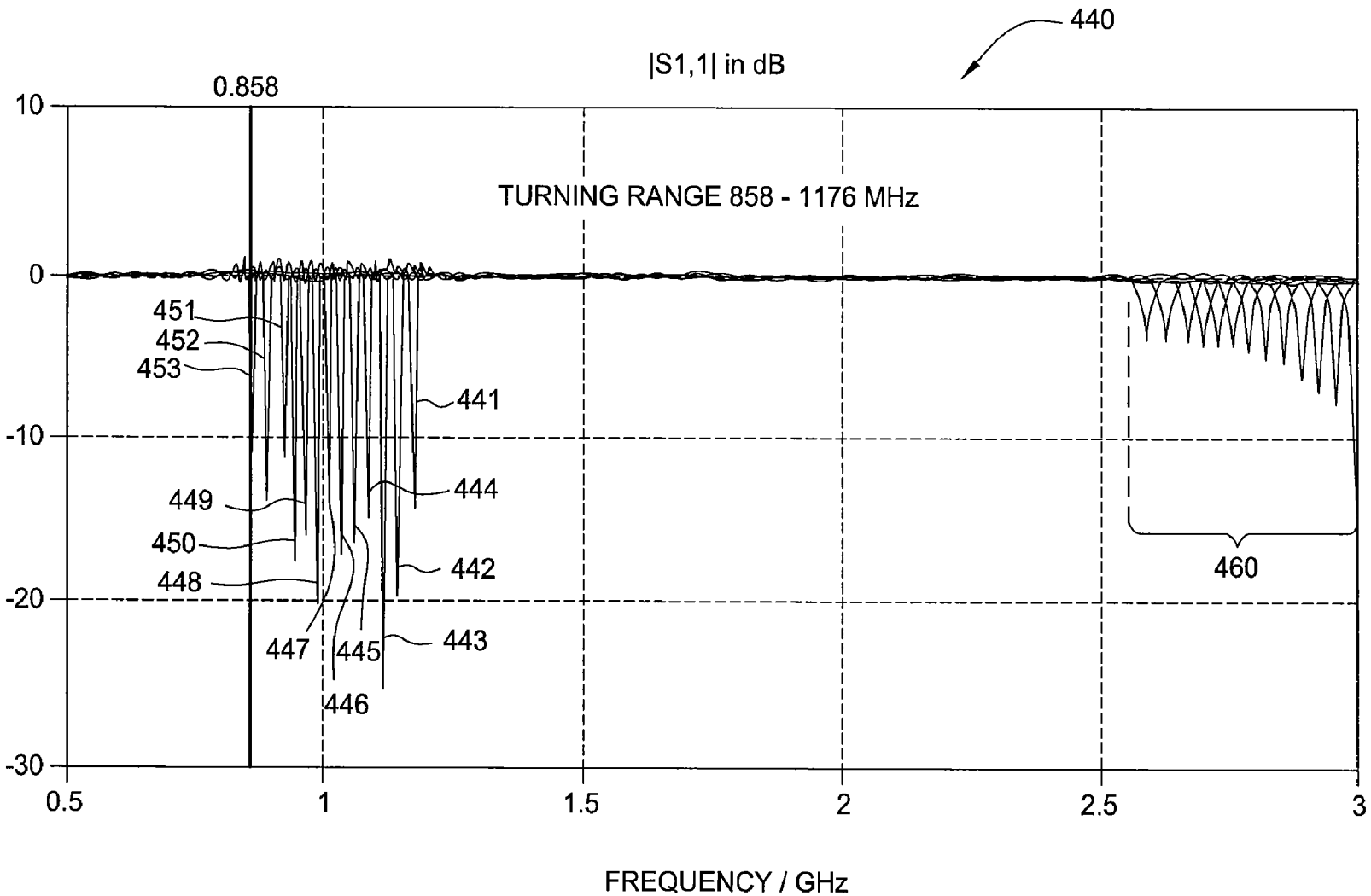

FIGS. 4A-4C display |S1,1| logMag plots at various tuned (resonant) frequencies of an exemplary iteration of patch antenna 200, constructed with particular dimensions to be provided below. It should be stressed however, that any listed dimensions, geometries, and/or response characteristics thereof are provided strictly for illustrative purposes, and various embodiments as a whole are not necessarily constrained to any particular dimensions or geometries discussed herein. The exemplary patch antenna 200 utilized to obtain the plots in FIGS. 4A-4C has a radiating element 210 of 30×24 mm, extension patch pairs $\mathbf{212}_1$ and $\mathbf{212}_2$ of 5×24 mm, switches 240 of 1×1 mm (thereby producing a gap width between elements of 1 mm), and substrate 230 of 1 mm 80×70 mm with a relative permittivity ($\epsilon_r$) of 3. The ground plane 220 is the same size as substrate 230, and separated from radiating element 210 of 30×24 mm, extension patch pairs $\mathbf{212}_1$ and $\mathbf{212}_2$ of 5×24 mm by the width of the substrate 230 (i.e., 1 mm). Those skilled in the art and informed by the teachings herein will recognize that the separation between radiating elements and the ground plane of a patch antenna should be small compared to wavelength (λ). As mentioned however, the overall scope herein is not dependent on this distance distances or any particular dimensions related to a specific embodiment. Thus, any suitable distance may be utilized. But, radiating element to ground plane separations 1/(20λ) or less are typical in existing patch antenna implementations.

FIG. 4A displays an exemplary |S1,1| logMag plot 400 of patch antenna 200 with the particular dimensions described above, in its base mode of operation; that is both RF switch pairs $\mathbf{240}_1$ and $\mathbf{240}_2$ are in an off (non-conducting position). In the particular embodiment with respect to plot 400, patch antenna 200 is tuned over 1650-2673 MHz. Each tuning increment is represented by a respective trace 401-411. It should be emphasized however, that any particular tuning range disclosed in plot 400 (i.e., 1650-2673 MHz) or anywhere herein, are provided as examples pertaining to a specific embodiment. Other and further tuning increments and ranges are also contemplated both for the iteration of patch antenna 200 being discussed, and various other embodiments, which do not depart from the basic scope. In the referenced configuration (i.e., switch pairs $\mathbf{240}_1$ and $\mathbf{240}_2$ in an off position), the effective physical dimensions of the radiating portion (i.e., radiating element 210) of patch antenna 200 are similar to length 'L' and width 'W' of patch antenna 100, as previously described. But, the resonant frequency of the antenna is adjusted according to one embodiment, by altering the lumped capacitance value of capacitive element pairs $\mathbf{250}_1$, enabling the operational frequency of the antenna even in its base mode of operation, to not be constrained exclusively to its physical dimensions. As capacitance increases, the tuned frequency of the antenna decreases.

Table 1 displays tuned capacitance values (in Farads) of capacitive element pairs $\mathbf{250}_1$, respectively corresponding to each trace 401-411 of plot 400.

TABLE 1

Tuned Capacitance Values of Capacitive Element Pairs $250_1$, for FIG. 4A Traces 401-411

| TRACE | CAPACITANCE (F) |
|---|---|
| 401 | 4.00E−13 |
| 402 | 9.60E−13 |
| 403 | 1.52E−12 |
| 404 | 2.08E−12 |
| 405 | 2.64E−12 |
| 406 | 3.20E−12 |
| 407 | 3.76E−12 |
| 408 | 4.32E−12 |
| 409 | 4.88E−12 |
| 410 | 5.44E−12 |
| 411 | 6.00E−12 |

Trace 401 with the least capacitance (4.00E-13F), produces the highest resonant frequency of approximately 2.67 GHz. Trace 411 with the most capacitance (6.00E-12), produces the lowest resonant frequency of approximately 1.57 GHz.

Examination of traces 401-411 indicates the embodiment of patch antenna 200 currently being referenced, exhibits high 'Q' tuning characteristics and/or adjacent channel rejection/isolation (filtering) at each respective tuned frequency. As such, various embodiments are well suited for cosite mitigation applications. However, other embodiments are also contemplated where 'Q' is reduced, and/or an antenna is intentionally configured to have a broadened instantaneous bandwidth, without departing from the overall scope.

FIG. 4B displays a plot 420 according to one embodiment, wherein the switches of RF switch pair $\mathbf{240}_1$ of patch antenna 200 are closed, thereby electrically adjoining radiating element extension pairs $\mathbf{212}_1$ to element 210. The effective physical width of the radiating portion of patch antenna 200 with respect to the previously given dimensions thus effectively becomes 40 mm (i.e., $W+2*\Delta W_1$=30 mm+2*5 mm=40 mm), while the resonant frequency of the patch antenna 200 is correspondingly reduced resultant from its radiating portion becoming longer. Capacitive elements $\mathbf{250}_2$ are then utilized in a similar fashion as capacitive elements $\mathbf{250}_2$ discussed above, to provide impedance matching and reduce the resonant frequency even further with element extension pairs $\mathbf{212}_1$ now added as radiating elements. That is, the resonant frequency of patch antenna 200 is incrementally reduced by respectively increasing the lumped capacitance values of capacitive elements $\mathbf{250}_2$.

Similar to plot 400, plot 420 includes traces 421-431, displaying various resonant (tuned) frequency values for patch antenna 200 with radiating element extension pairs $\mathbf{212}_1$ adjoined to element 210, corresponding to respective tuned capacitance values of capacitive elements $\mathbf{250}_2$. Table 2, identically to Table 1, displays tuned capacitance values for capacitive element pairs $\mathbf{250}_2$ corresponding to each respective trace 421-431.

TABLE 2

Tuned Capacitance Values of Capacitive Element Pairs $250_2$, for FIG. 4B Traces 421-431

| TRACE | CAPACITANCE (F) |
|---|---|
| 421 | 6.00E−13 |
| 422 | 1.14E−12 |
| 423 | 1.68E−12 |
| 424 | 2.22E−12 |
| 425 | 2.76E−12 |
| 426 | 3.30E−12 |
| 427 | 3.84E−12 |
| 428 | 4.38E−12 |
| 429 | 4.92E−12 |
| 430 | 5.46E−12 |
| 431 | 6.00E−12 |

FIG. 4C displays a plot 440 according to one embodiment, wherein the switches of RF switch pairs $\mathbf{240}_1$ and $\mathbf{240}_2$ of patch antenna 200 are closed, adjoining radiating element extension pairs $\mathbf{212}_2$ are electrically adjoined with element 210 and radiating element extension pairs $\mathbf{212}_1$. The effective physical width of the radiating portion of patch antenna 200 with respect to the previously provided dimensions thus becomes 50 mm (i.e., $W+2*\Delta W_1+2*\Delta W_2$=30 mm+2*5 mm+2*5 mm=50 mm), while the resonant frequency of the patch antenna 200 is reduced resultant from its radiating structure(s) becoming longer. Capacitive elements $\mathbf{250}_3$ are then utilized in a similar manner as capacitive elements $\mathbf{250}_1$ and $250_2$ discussed above, to additionally tune and impedance match the antenna with both radiating element extension pairs $212_1$ and $212_2$ now adjoined.

Plot 440 additionally includes a harmonic region 460. Those skilled in the art and informed by the teachings herein will be cognoscente of the fact that harmonics may occur in any antennas or electromagnetic structures due to higher order modes. Higher order modes of the lowest tunable band structure exhibit spurious harmonics near the highest frequency of the highest frequency tunable band in FIG. 4A, thereby indicting that little or no cross-talk or overlapping signal will be exhibited in the usable channel from the lowest band to the highest band.

Similar to plots 400 and 420, plot 440 includes traces 441-453 for various tuning increments for a corresponding tuned capacitance value of capacitive element $250_3$, over (as an example) 858-11176 MHz. As with previously discussed Tables 1 and 2, the capacitance value for capacitive element 250, corresponding to each trace 441-453, is displayed in Table 3.

TABLE 3

Tuned Capacitance Values of Capacitive Element Pairs $250_3$, for FIG. 4C Traces 441-453

| TRACE | CAPACITANCE (F) |
|---|---|
| 441 | 7.00E−13 |
| 442 | 1.23E−12 |
| 443 | 1.76E−12 |
| 444 | 2.29E−12 |
| 445 | 2.82E−12 |
| 446 | 3.35E−12 |
| 447 | 3.88E−12 |
| 448 | 4.41E−12 |
| 449 | 4.94E−12 |
| 450 | 5.47E−12 |
| 451 | 6.00E−12 |
| 452 | 7.00E−12 |
| 453 | 8.00E−12 |

Plots 400, 420 and 440, along with the respective capacitance values in Tables 1-3, were obtained through computational electromagnetic (CEM) simulation. But, a skilled artisan informed by the teachings herein will also appreciate that capacitance values for patch antenna 200 and other embodiments in accordance with the basic scope, may also be obtained empirically.

The various embodiments discussed herein may also be described in terms of a method for tuning a patch antenna, comprising selectively adjoining one or more radiating element extensions successively to a radiating element of the patch antenna, adjusting fringe capacitance at active outer edges of the patch antenna. In one embodiment, a method is used to replace or alternate a pre-selected filter associated with a narrow-band tunable antenna to achieve radio wave detection and tunable channel selection.

While the foregoing is directed to various embodiments of the present invention, other and further embodiments of the invention may be devised without departing from the basic scope thereof. As such, the appropriate scope of the invention is to be determined according to the claims, which follow.

What is claimed is:

1. A patch antenna, comprising:

a radiating element;

one or more radiating element extension pairs;

a ground plane disposed beneath the radiating element and the one or more radiating element extension pairs;

coupling means for selectively adjoining the one or more radiating element extension pairs to the radiating element; and one or more pairs of capacitive element pairs, each capacitive element of a pair of capacitive elements disposed between a respective radiating element extension of a radiating element extension pair and the ground plane.

2. The patch antenna of claim 1, wherein at least one capacitive element is disposed at an outer edge of a radiating element extension.

3. The patch antenna of claim 1, wherein at least one capacitive element is tunable.

4. The patch antenna of claim 3, wherein capacitive elements at active outer edges of the patch antenna are tuned to affect the resonant frequency of the patch antenna.

5. The patch antenna of claim 1, further comprising a microstrip feed line for interacting with the radiating element.

6. The patch antenna of claim 3, wherein capacitive elements at active outer edges of the patch antenna are tuned to affect the impedance match of the patch antenna.

7. The patch antenna of claim 5, wherein the ground plane extends beneath the microstrip feed line.

8. The patch antenna of claim 7, wherein a dielectric substrate is disposed between the radiating element and the ground plane.

9. The patch antenna of claim 7, wherein the capacitive elements pass through the dielectric substrate.

10. The patch antenna of claim 1, wherein the coupling means comprises PIN diodes.

11. The patch antenna of claim 1, wherein the coupling means comprises micro electro-mechanical system (MEMS) switches.

12. The patch antenna of claim 2, wherein the capacitive elements comprise varactor diodes.

13. A patch antenna, comprising:

a radiating element;

one or more pairs of radiating element extensions;

a ground plane; and tunable capacitive elements disposed between the radiating element extensions and the ground plane;

wherein the ground plane is disposed beneath the radiating element and the one or more radiating element extension pairs.

14. The patch antenna of claim 13, further comprising:

coupling means for selectively adjoining the one or more radiating element extensions successively to the radiating element.

15. A patch antenna, comprising:

a radiating element;

one or more radiating element extension pairs; and coupling means for selectively adjoining the one or more radiating element extension pairs successively to the radiating element to form a transmission line, the transmission line further including one or more capacitive elements disposed between each radiating element extension and a ground plane, the transmission line exhibiting at an end a corresponding conductance representing a radiation conductance of the patch antenna and a corresponding susceptance including a fringing capacitance of the radiating element and a lumped capacitance of one or more capacitive elements.

16. The patch antenna of claim 15, further comprising:

the ground plane disposed beneath the radiating element and the one or more radiating element extensions; and tunable capacitive elements disposed between the ground plane and the radiating element.

17. A method for tuning a patch antenna, comprising:

selectively adjoining one or more radiating element extensions successively to a radiating element of the patch antenna; and adjusting fringe capacitance at active outer edges of the patch antenna by adapting at least one tunable capacitive element coupled between a respective radiating element extension and a ground plane.

18. The method of claim 17, wherein the fringe capacitance is adjusted via a plurality of tunable capacitive elements.

19. The method of claim 18, wherein the tunable capacitive elements comprise varactor diodes.

20. The method of claim 17, wherein the selecting is provided using RF switches.

21. The method of claim 18, wherein the RF switches comprise micro electro-mechanical system (MEMS) switches.

22. The method of claim 20, wherein the RF switches comprise PIN diodes.

* * * * *